US006125598A

United States Patent [19]

Lanphier

[11] Patent Number: 6,125,598

[45] Date of Patent: Oct. 3, 2000

[54] MODULAR TRADITIONAL STAIRCASE

[76] Inventor: Lee Lanphier, 1750 Anderson Creek Rd., Talent, Oreg. 97540

[21] Appl. No.: 09/086,705

[22] Filed: May 28, 1998

Related U.S. Application Data

[60] Provisional application No. 60/047,778, May 28, 1997.

[51] Int. Cl.[7] ..... E04F 11/025; E04F 11/09; E04F 11/18

[52] U.S. Cl. ..... 52/182; 52/184; 52/188; 52/191; 52/179; 52/720.2; 256/65

[58] Field of Search ..... 52/182, 184, 187, 52/188, 191, 720.2, 179; 108/92; 256/59, 65

[56] References Cited

U.S. PATENT DOCUMENTS

| | | | |
|---|---|---|---|
| 569,464 | 10/1896 | Moore | 52/188 |
| 1,925,642 | 9/1933 | Meredith . | |
| 2,021,457 | 11/1935 | MacKenzie | 52/191 |
| 2,724,466 | 11/1955 | Phillips . | |
| 3,393,481 | 7/1968 | Meuret | 52/188 |
| 3,474,882 | 10/1969 | Ernst . | |
| 3,707,814 | 1/1973 | Seegers . | |
| 3,909,997 | 10/1975 | Eickhof | 52/188 |
| 4,015,687 | 4/1977 | Dean . | |
| 4,106,591 | 8/1978 | Cohen et al. . | |
| 4,296,577 | 10/1981 | Schuette . | |
| 4,322,927 | 4/1982 | Scott . | |
| 4,344,604 | 8/1982 | Basey . | |
| 4,352,485 | 10/1982 | Basey . | |
| 4,373,609 | 2/1983 | De Donato . | |
| 4,403,767 | 9/1983 | Basey . | |
| 4,422,270 | 12/1983 | LaPointe et al. . | |
| 4,464,870 | 8/1984 | Crepeau . | |
| 4,533,121 | 8/1985 | Basey . | |
| 4,583,334 | 4/1986 | Hubbard . | |
| 4,635,416 | 1/1987 | Ayala . | |
| 4,709,520 | 12/1987 | Vochatzer . | |
| 4,757,653 | 7/1988 | Anderholm . | |
| 4,850,164 | 7/1989 | McLeod . | |
| 4,866,894 | 9/1989 | Brown . | |
| 4,875,315 | 10/1989 | Champagne . | |
| 4,951,434 | 8/1990 | Schmidt . | |
| 5,029,818 | 7/1991 | Katz . | |
| 5,051,289 | 9/1991 | Riddle . | |
| 5,056,283 | 10/1991 | Sapinski . | |
| 5,205,093 | 4/1993 | Schuette . | |
| 5,261,201 | 11/1993 | Smith | 52/184 |
| 5,293,722 | 3/1994 | Reimann | 52/182 |
| 5,400,556 | 3/1995 | Favaron . | |
| 5,402,610 | 4/1995 | Salva' et al. . | |
| 5,437,433 | 8/1995 | Rezek . | |
| 5,465,459 | 11/1995 | Hopkins . | |
| 5,502,933 | 4/1996 | Skillern . | |
| 5,613,341 | 3/1997 | Skillern . | |
| 5,632,124 | 5/1997 | Weingarten et al. . | |
| 5,667,199 | 9/1997 | Hamm . | |
| 5,720,136 | 2/1998 | Turner . | |
| 5,778,610 | 7/1998 | Berg . | |
| 5,791,101 | 8/1998 | Wallace | 52/182 X |
| 5,806,254 | 9/1998 | Bennett | 52/182 |
| 5,899,032 | 5/1999 | Buzby | 52/182 |

FOREIGN PATENT DOCUMENTS

| | | | |
|---|---|---|---|
| 2196035 | 4/1988 | United Kingdom | 52/182 |
| WO 89/02506 | 3/1989 | WIPO | 52/182 |

*Primary Examiner*—Laura Callo

*Attorney, Agent, or Firm*—Kolisch Hartwell Dickinson McCormack & Heuser

[57] ABSTRACT

A modular stairway assembled from a stringer having a relatively planar, flat top, an initial step module fixed adjacent a lower end of the stringer, and several intermediate step modules attached to the stringer. The initial step module includes an upper edge, and a portion of the first intermediate step module bears against the upper edge of the initial step module. A method of constructing the stairway includes the steps of placing the stringer in position relative to a structure, anchoring the initial step module adjacent a lower end of the stringer to define an initial riser and tread for the stairway, and to define an initial stop. A first of the intermediate step modules is supported on the module-supporting top of the stringer, and then a downward force is placed on the intermediate step module, thereby forcing the module along the top of the stringer into firm contact with the initial stop of the initial step module and insuring proper alignment of the intermediate step module to the initial step module. The intermediate step module is anchored to the stringer.

36 Claims, 7 Drawing Sheets

18
20
22
57
202
206
36c
204
10
42
48
44
12
38
34
16
76
82
80
52
54
46
40
48
200
78
80
32
50
14
36
36b
124
126
36a
26
36d
36e

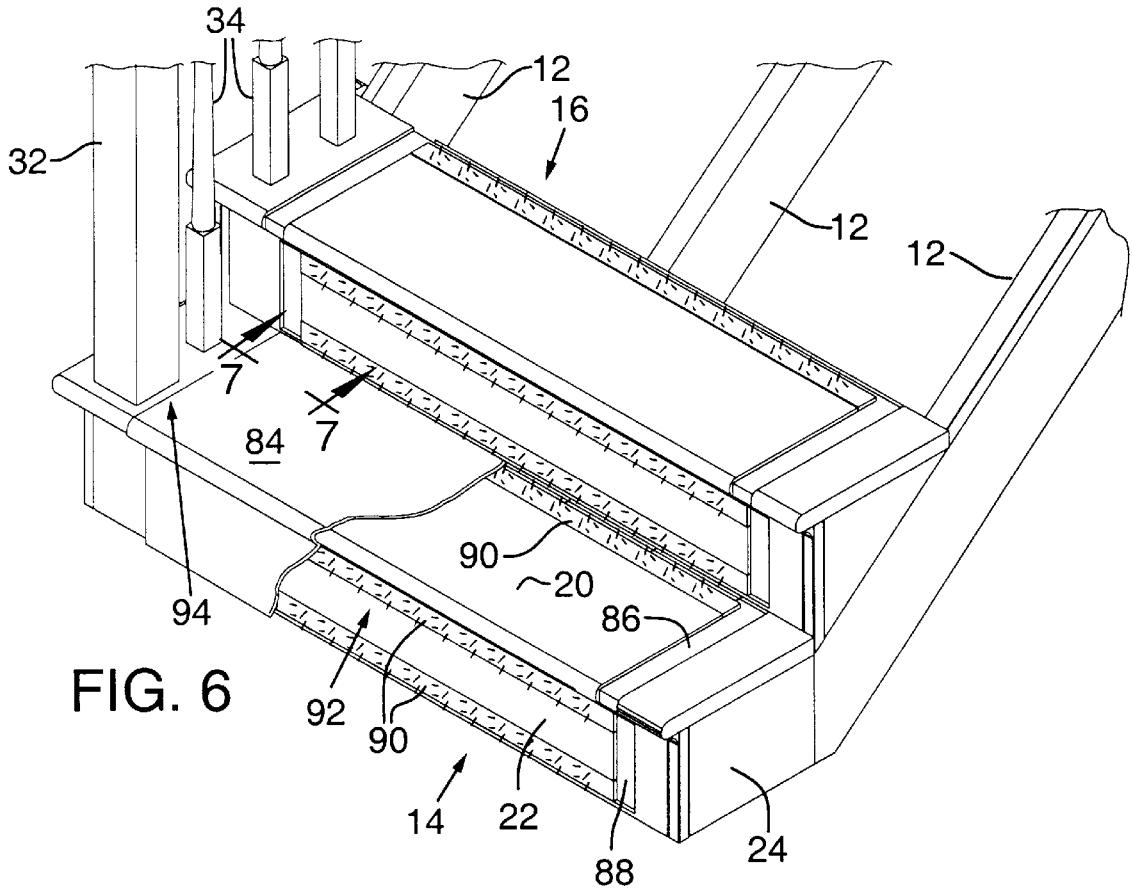
FIG. 6
FIG. 7
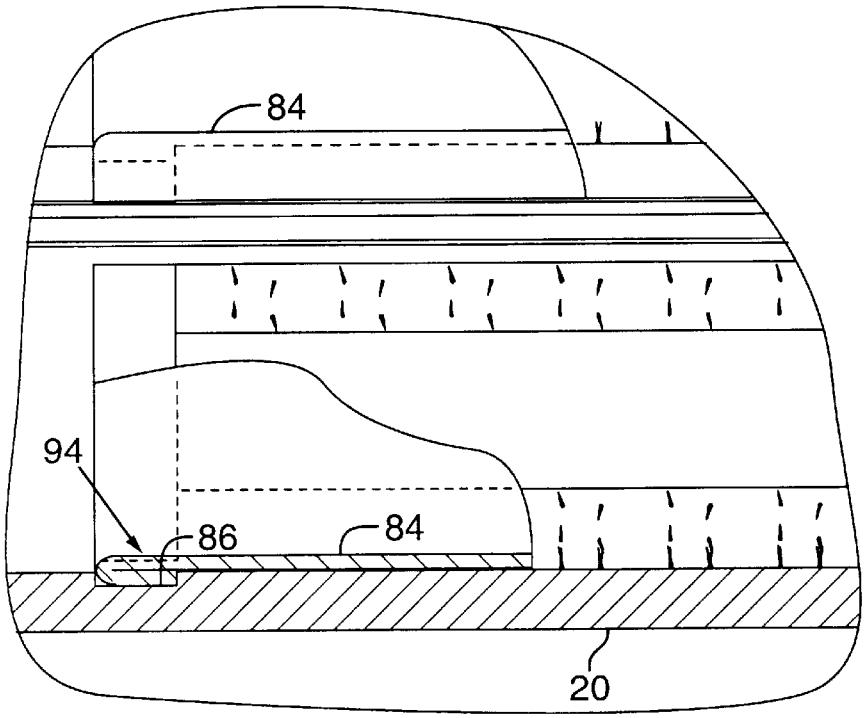

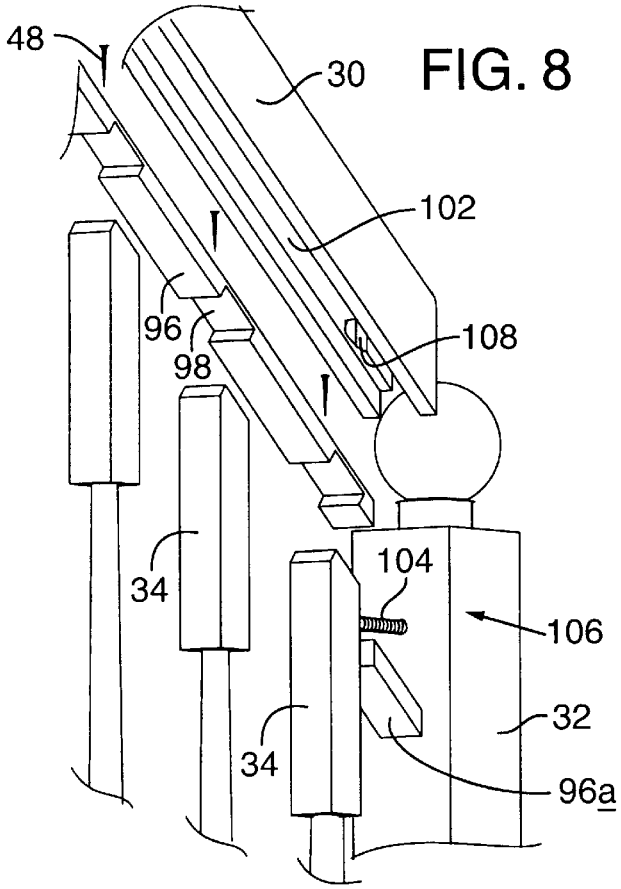
FIG. 8
FIG. 9
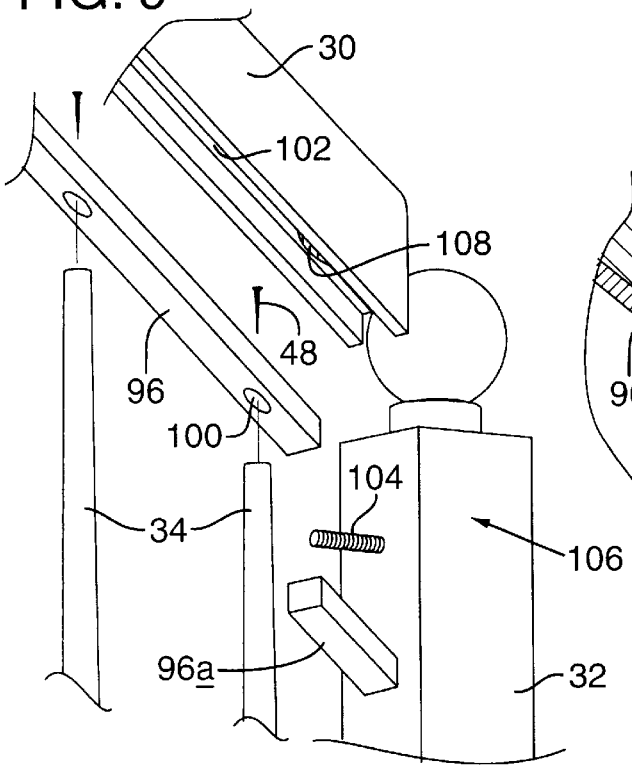
FIG. 10
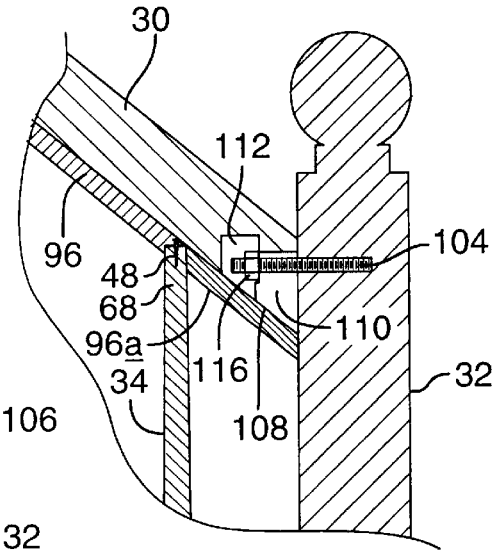

MODULAR TRADITIONAL STAIRCASE

CROSS-REFERENCE TO RELATED APPLICATIONS

This application claims priority from U.S. provisional patent application, Ser. No. 60/047,778, entitled "Modular Traditional Staircase," filed on May 28, 1997, the disclosures of which are incorporated herein by reference.

BACKGROUND AND SUMMARY OF THE INVENTION

The present invention relates generally to modular stairways. More particularly, it is a novel modular stairway in which the primary structural support for the stairway is provided by a stringer or stringers formed with a relatively planar flat top. The stringers may be conventional lumber, such as a two-by-six, or it may be made of engineered lumber such as linear veneer lumber (LVL), and the steps, railing, and other details of the stairway are defined by various pre-fabricated modules and components that interfit with such a simple stringer to form a surprisingly strong, unified, visually pleasing stairway. The devices and methods of the present invention may be applied to stairways of single straight flights or multiple flights with virtually any shape of landings between, and to both open staircases where the balustrade is mounted on the treads and closed staircases where balustrades, if used, are mounted on a rake wall adjacent to the treads.

In a conventional stairway, stringers are cut one at a time from oversized dimensional lumber, such as a conventional two-by-twelve, with notches cut so that the effective structural support of the lumber is approximately fifty-percent of its original thickness, equivalent to a two-by-six. The notches that are cut out of the two-by-twelve receive risers and treads for the stairway and the portions removed are discarded, wasting much lumber. They are difficult to cut consistently, leading to the development and use of numerous tools to mark and cut the stringer. Conventional stringers are difficult to erect and anchor on site in a way that maintains the required parallel and level relationship to each other, perpendicular relationship to the floor, and perpendicular relationship to the header to which they are attached.

Conventional stairway construction also involves substantial problems in the on-site fitting of individual tread and riser boards. Tread and riser boards are individually measured, cut to fit against and between the imprecise and irregular notches in the stringers, and anchored using fasteners that reduce the load-bearing capacity of the stringers. Furthermore, on-site attachment of balustrade, carpet, aesthetic fascia, and trim are time-consuming processes involving for each piece laborious measuring, cutting, and anchoring.

Others have recognized the drawbacks of conventional stairways, including the notched stringers often used, and have attempted to overcome these drawbacks by creating brackets and other devices for use in building stairways. For example, various stairway-related devices are disclosed in U.S. Pat. Nos. 4,464,870, 4,850,164, 4,875,315, 5,205,093, 5,502,933, 5,613,341, and 5,720,136, the disclosures of which are incorporated herein by reference. However, none of these prior art systems has provided the combination of a stairway that is easy to manufacture, structurally sound, and visually pleasing. In particular, none of the above-referenced stairways is believed to present a stairway that looks as if made using conventional construction techniques, particularly well-suited to a furniture-quality finished, exposed wood stairway. The stairway and method of the present invention do all of this, requiring minimal skill and only a screwdriver and drill to install a stairway that meets the needs of most building applications.

In the preferred embodiment, the stringers are interlocked prior to placement in the final structure to form a strong, properly aligned frame. The frame is placed in the desired position for the stairway, and anchored. Each step module is a pre-defined unit including a tread, riser and supporting block. An initial step module is anchored to the bottom of the stringers and to the floor supporting the stairway. Subsequent step modules simply are placed on the tops of the stringers, slid into place, bearing against the preceding module, and anchored with a few screws to the stringers and preceding module. The modules may include newel posts and balusters that interlock with predefined handrail components to define a railing. The modules also may include specially designed grooves that allow the attachment of carpet to the stairway in a very clean, efficient and attractive manner. Many of these aspects of the invention may have application to stairways using conventional notched stringers.

The advantages of the present invention will be understood more readily after a consideration of the drawings and the Detailed Description of the Preferred Embodiment.

BRIEF DESCRIPTION OF THE DRAWINGS

FIG. 6 is an isometric view of an alternative embodiment of the step modules shown in FIG. 1, including flush fascias on the ends of the step modules and further including grooves and carpet tack strips for the attachment of carpet.

FIG. 7 is a cross-sectional view of the step module of FIG. 6, taken generally along line 7—7 in FIG. 6.

FIG. 8 is an exploded, isometric view of a portion of the railing shown in FIG. 1, taken from below and behind the railing, approximately 180-degrees opposite from the view point of FIG. 1, showing the interconnection among a handrail, balusters, intervening anchor fillet strip and newel post.

FIG. 9 is an exploded, isometric view of a portion of an alternative embodiment of the railing shown in FIG. 1, taken from approximately the same point of view as in FIG. 8.

FIG. 10 is a cross-sectional view of a portion of the railing shown in FIG. 1, taken generally along line 10—10 in FIG. 1.

DETAILED DESCRIPTION OF THE PREFERRED EMBODIMENT

Figure 1:
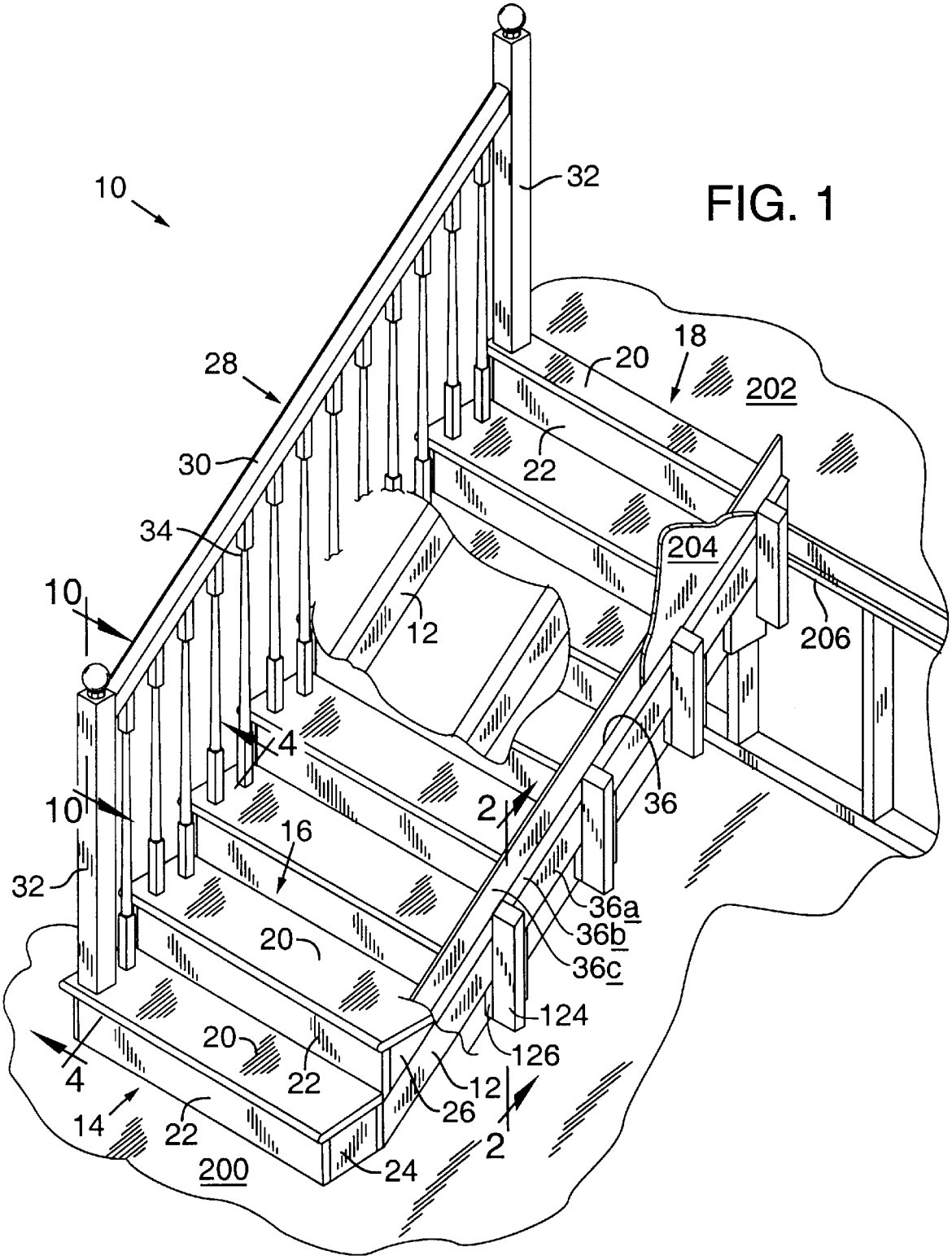
FIG. 1 is an isometric view of a stairway according to the present invention, shown viewed through a wall adjacent the stairway, with protective vertical studs attached to the wall side of the stairway, and with a portion of the steps of the stairway cut away to expose stringers supporting the steps.

Referring to FIG. 1, a modular stairway 10 according to the present invention is shown. The primary structural support for stairway 10 is provided by predefined stringers 12, upon or adjacent which various step-defining modules are attached. For example, an initial step tread/riser module 14 is attached adjacent the bottom end of stringers 12, a plurality of intermediate step tread/riser modules 16 are attached to a top face of stringers 12 and a landing tread module 18 is attached adjacent a top end of stringers 12. Preferably, each of modules 14, 16, and 18 includes a tread 20 and a riser 22, defining the exposed surfaces of the steps of stairway 10.

Initial step module 14 is a self-contained structural unit, with rectangular blocks 24 interconnecting tread 20 and riser 22. Blocks 24 preferably support tread 20 directly from a floor 200 underlying initial step module 14. A triangular block 26 interconnects tread 20 and riser 22 of each intermediate step module 16. Triangular blocks 26 support a respective tread 20 substantially directly from stringers 12. Landing tread module 18 does not include a block interconnecting its tread 20 to its riser 22. Rather, landing tread module 18 is supported from a landing 202, adjacent the upper end of stairway 10.

Still referring to FIG. 1, a railing 28 is shown adjacent one edge of stairway 10. Railing 28 includes a handrail 30 extending between newel posts 32, with intermediate support provided by a plurality of balusters 34. A similar railing may be formed on the opposite edge of stairway 10, if both sides of stairway 10 are to be exposed.

Alternatively, stairway 10 may be mounted adjacent a wall, or between two walls. In such an installation, the walled edge or edges of stairway 10 is enclosed by wall covering material 204, such as a wallboard. Preferably, wallboard 204 is mounted to stairway 10 by an upwardly facing elongate channel 36 to one of stringers 12, as shown in FIG. 1. This has been found to maintain a close interconnection between wallboard 204 and the edge of stairway 10, providing a finished, quality appearance that is difficult to obtain using prior art stairways. Channel 36 may be formed of a single piece of bent metal in combination with stringer 12, or, as shown in FIG. 1 and in detail in FIG. 2, by a board 36*a*, an outer metal wall 36*b*, and an exposed wall skirt 36*c*. Filler boards 36*d* and 36*e* may be used so that wall skirt 36*c* is flush with treads 20 and risers 22, as shown, with the lower portion of wall skirt 36*c* also abutting filler boards 36*d* and 36*e*.

Figures 2, 3:
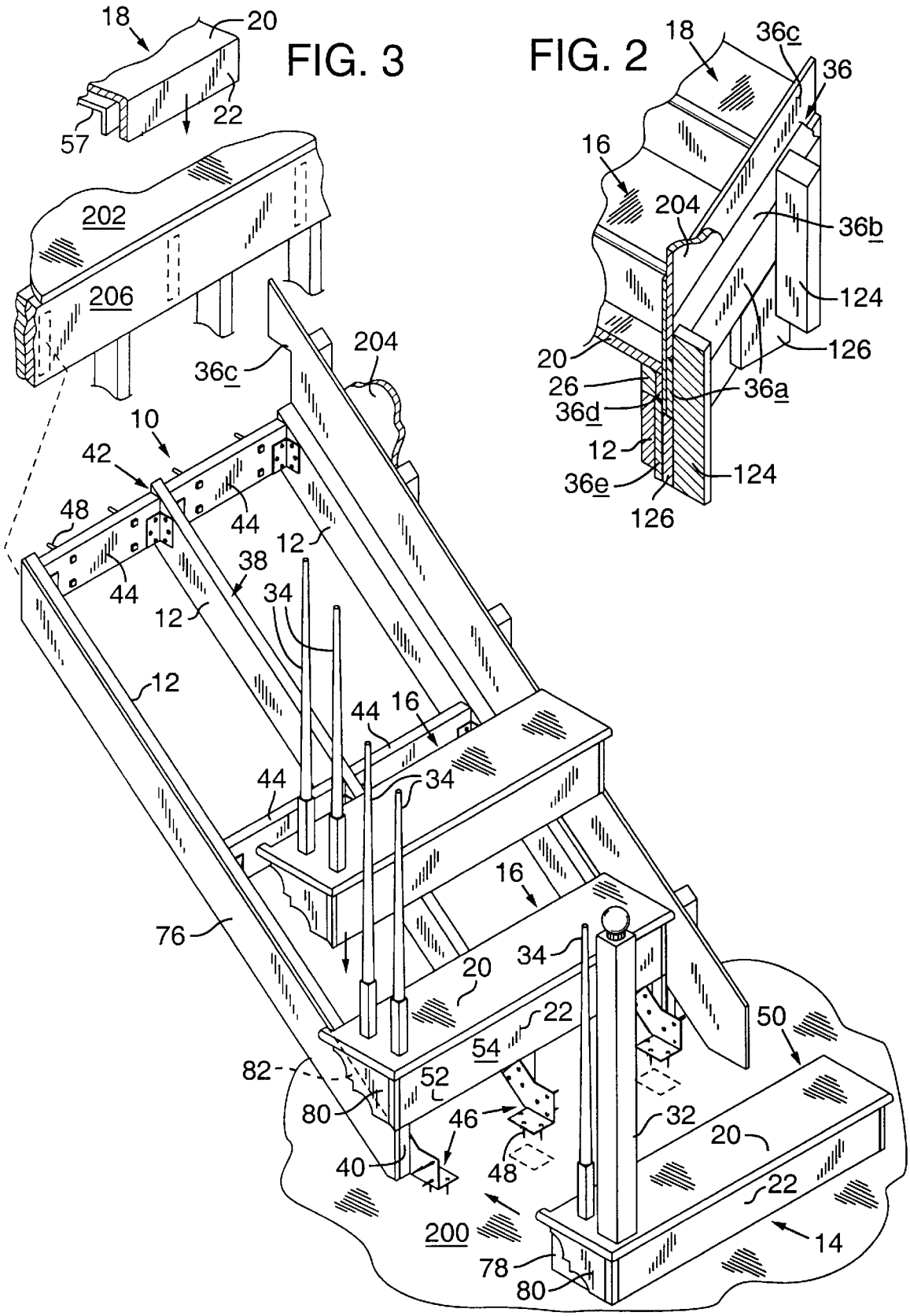
FIG. 2 is a cross-sectional detail view of an outer portion of the stairway of FIG. 1, taken along line 2—2 in FIG. 1.
FIG. 3 is an isometric view of the opposite side of the stairway shown in FIG. 1, partially assembled.

Turning now to FIG. 3, an exploded, view of stairway 10 is shown from the opposite side of the stairway to that seen in FIG. 1. Each stringer 12 includes a module-supporting top 38, preferably a relatively planar flat top 38. A lower vertical end 40 of stringer 12 abuts rectangular block 24 of initial step module 14, and is supported by underlying floor 200. An upper vertical end 42 of stringer 12 bears against a header 206, formed as part of landing 202.

One or more webs 44 may interconnect a plurality of parallel stringers 12, to maintain a predefined spacing between stringers 12. By using several webs 44 distributed along the length of stringers 12, stringers 12 may be locked in relationship to one another to form a frame, preferably before placing stringers 12 in place in the building. The frame may be erected and anchored as one unit to floor 200 and header 206. By locking stringers 12 together prior to placing the frame in its final position, a more level and square frame for stairway 10 is obtained. This results in a much better alignment of step modules 14, 16 and 18 to each other, with a better looking and performing finished stairway 10.

Preferably, one web 44 is located adjacent upper vertical end 42 of stringers 12, and serves as an anchor plate to anchor or attach stairway 10 to header 206. A floor anchor bracket 46 interconnects stringer 12 to initial step module 14, and simultaneously anchors stringer 12 and initial step module 14 to floor 200. Fasteners 48 may be used to attach bracket 46 to a stringer 12, initial step module 14, floor 200 and header 206. It will be appreciated that different sizes and designs of fasteners 48 may be used, as shown in the drawings, and understood by those having skill in the art of construction.

Figure 4:
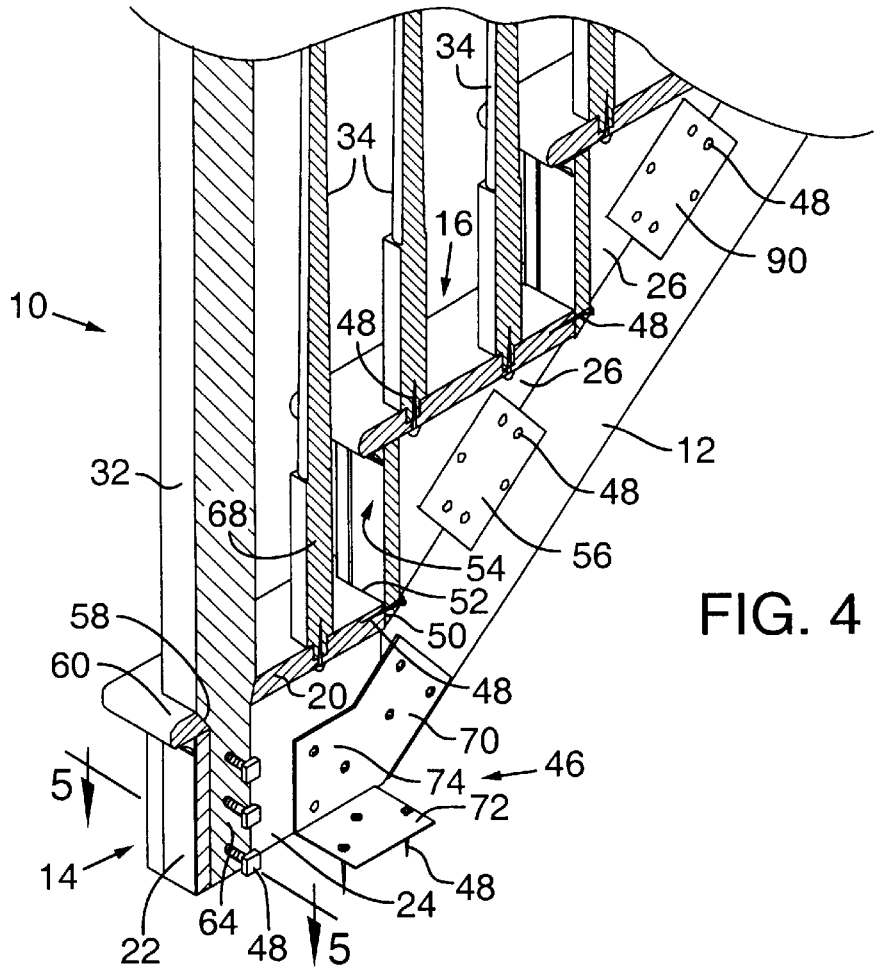
FIG. 4 is a cross-sectional isometric detail view of a lower portion of the stairway of FIG. 1, taken along line 4—4 in FIG. 1.

Referring now to FIGS. 3 and 4 collectively, a rear edge 50 of initial step module 14 forms a vertical upper edge or stop 50 of initial step module 14. Stop 50 is used to assure proper alignment of the first intermediate step module 16 to initial step module 14, and of subsequent intermediate step modules 16 to preceding intermediate step modules 16. Specifically, when each intermediate step module 16 is supported on module-supporting top 38 of stringer 12, and a downward force 208 is placed upon intermediate step module 16, module 16 is forced along top 38 of stringer 12 into firm contact with stop 50. More specifically, bottom portion 52 of exposed face 54 preferably makes substantial planar contact with stop 50 of initial step module 14.

Once intermediate step module 16 is aligned properly with initial step module 14, it is anchored to stringer 12 and to initial step module 14. A mending plate 56 extends over both triangular block 26 of intermediate step module 16, and stringer 12. Fasteners 48 then extend through mending plate 56 into both triangular block 26 and stringer 12. Furthermore, additional fasteners 48 preferably extend through bottom portion 52 of riser 22, into stop 50 of tread 20. If desired, predefined holes may be formed in riser 22 and/or tread 20, and mending plate 56 may be pre-attached to triangular blocks 26, simplifying the amount of manual effort required during the installation phase of stairway 10. Landing tread module 18 is attached to landing 202 and header 206 with L-shaped brackets 57, that also interconnect tread 20 to riser 22, as shown in FIG. 3.

In the event that some adjustment is needed in matching stairway 10 to floor 200 and landing 202, it is best accomplished with landing tread module 18. Riser fascia 22 may be separated from tread 20 and bracket 57. After tread 20 and bracket 57 are attached to landing 202, riser fascia 22 may be attached. This allows riser fascia 22 to be adjusted to match the dimensions of the surrounding structure.

Figure 5:
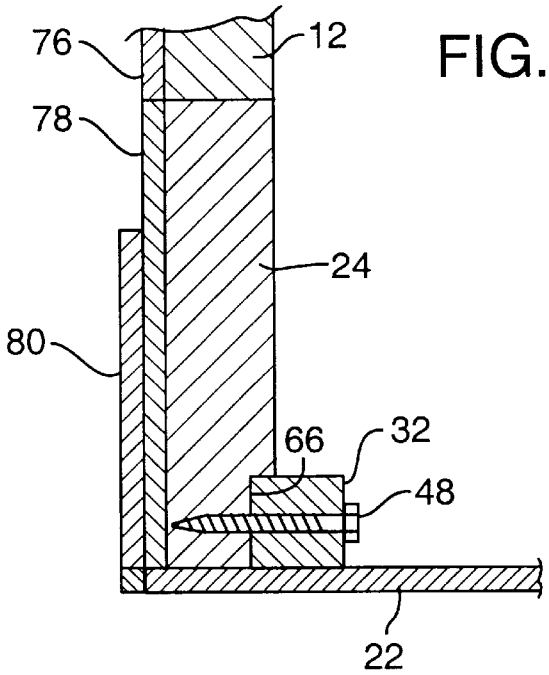
FIG. 5 a cross-sectional view of one of the step modules shown in FIG. 4, taken along line 5—5 in FIG. 4.

It will be noted in FIG. 3 that modules 14, 16 and 18 preferably are anchored to stringers 12 only after newel posts 32 and balusters 34 have been attached. These attachments are seen best in FIG. 4. The lower newel post 32 is attached to initial step module 14, preferably by extending through a hole 58 formed adjacent front edge 60 of exposed face 62 of tread 20. Hole 58 may extend completely through tread 20, in which case a lower portion 64 of newel post 32 may extend into initial step module 14 to abut riser 22 and rectangular block 24. Lower portion 64 of newel post 32 then may be attached to riser 22 and/or rectangular block 24 by a plurality of fasteners 48, such as lag bolts. An even stronger joint between newel post 32 and riser 22 and/or rectangular block 24 is obtained by notching riser 22 and/or rectangular block 24. Referring briefly to FIG. 5, a cross section of initial step module 14 and newel post 32 is shown, with such a notch 66 formed in rectangular block 24.

Returning to FIG. 4, balusters 34 are attached to corresponding treads 20 by a baluster fastener 48 that extends through tread 20 and into an interior portion 68 of each baluster 34. A similar attachment mechanism may be used to attach upper newel post 32 to landing tread module 18, with a fastener 48 extending through tread 20 and L-shaped bracket 57 of landing tread module 18, and into an interior of upper newel post 32. Depending on the length of stairway 10, it may be desirable to provide additional vertical and lateral support for railing 28. An intermediate newel post 32 may be mounted to an intermediate step module 16 in the same way that newel post 32 is mounted to initial step module 14. As a further alternative, one or more of balusters 34 may be mounted in the manner shown in FIG. 5 for newel post 32.

The details of floor anchor bracket 46 also are shown in FIG. 4. Bracket 46 includes a tilted, upright stringer portion 70, a flat floor portion 72, and an interconnecting upright step portion 74. Stringer portion 70 and step portion 74 preferably are coplanar, with floor portion 72 extending approximately perpendicular to the plane of portions 70 and 74. Preferably, anchor bracket 46 first is attached to stringer 12 using fasteners 48, and then attached to floor 200 with fasteners 48 once stringer 12 is placed properly relative to floor 200 and header 206. Initial step module 14 then is placed to abut lower vertical end 40 of stringer 12, and additional fasteners 48 may be used to attach anchor bracket 46 to a corresponding rectangular block 24.

Returning attention to FIG. 3, the exposed face of stairway 10, hidden in FIGS. 1 and 2, is shown. A furniture-quality, exposed, finished visual appearance of stairway 10 is provided through the use of various fascia of a desired wood. Stringer 12 optionally may include an exposed fascia 76, rectangular block 24 may include an exposed fascia 78, and triangular blocks 26 may include an exposed fascia 80. Furthermore, an exposed fascia 80 may be layered on top of fascia 78 so that a more unified appearance of stairway 10 is obtained, or, preferably, fascia 78 may be shaped with a router to create the layered effect shown in the drawings.

Fascias 78, 80, and 82 may be sized to abut each other and, for fascias 80 and 82, to abut the corresponding tread 20 and riser 22, so that very few gaps are visible between the abutting members. This would look very much like the look of blocks 24 and 26, as exposed in FIG. 1. However, a more ornate look may be provided, as shown in FIG. 3, through the use of overlapping fascia 80. Exposed fascia 80 each forms an oversized bracket, with an extended edge 82 that overlaps stringer 12 when intermediate step module 16 is supported properly on stringer 12. The overlap caused by extended edge 82 covers substantially the joint between intermediate step module 16 and stringer 12. Furthermore, it provides a particularly pleasing ornamental appearance of stairway 10.

In the drawings, fascia 80 and riser 22 are shown meeting at a square filler, as seen best in FIG. 5. Alternatively, the edges of fascia 80 and riser 22 may be mitered, as will be understood by those having skill in the art of construction. Similar variations may be used in the joining of the various elements to each other, unless indicated otherwise.

A carpeted version of intermediate step module 16 is shown in FIGS. 6 and 7, with a piece of carpet 84 applied to initial step module 14. A carpet groove 86 is formed in exposed face 62 of tread 20, and a matching groove 88 also is formed in exposed face 52 of riser 22. Grooves 86 and 88 may be formed as a rabbet at an outer edge of tread 20 and riser 22, or, as shown in FIGS. 6 and 7, as a slot formed inwardly of the outer edge of tread 20 and riser 22. Preferably, parallel grooves 86 and 88 are formed on tread 20 and riser 22, extending along or inwardly of the outer edges of tread 20 and riser 22.

A carpet tack strip 90 is attached to tread 20 adjacent rear edge 50, and parallel carpet tack strips 90 are attached to top portion 92 and bottom portion 52 of riser 22. Piece of carpet 84 then is stretched between corresponding tack strips 90, to extend over tread 20 and riser 22. Outer edges 94 of carpet 84 are folded under and received by grooves 88, as shown. This results in a clean, secure, and very attractive attachment of carpet 84 to each module 16. A similar construction may be used in both initial step modules 14 and landing tread module 18.

Referring next to FIG. 8, the interconnections of handrail 30, newel post 32, and balusters 34 are shown in detail. Handrail 30 preferably is attached to balusters 34 through the use of an intervening anchor fillet strip 96. As shown in FIG. 6, indentations 98 are formed in fillet strip 96, corresponding to each baluster 34. A baluster fastener 48 then extends into interior portion 68 (see FIG. 4) of each baluster 34. If the tops of balusters 34 are conical or cylindrical, fillet strip 96 is counter-bored, as shown by bores 100 in FIG. 9.

Handrail 30 is shaped to mate with anchor strip 96. Specifically, a plow 102 is formed in the underside of handrail 30, sized to encompass the top and edges of anchor strip 96. Preferably, handrail 30 is attached to anchor strip 96 through the combination of adhesives within plow 102, and optionally selective placement of screws or other fasteners, not shown, extending through anchor strip 96 and into handrail 30. The combination of indentations 98 or 100, fasteners 48, and plow 102 combine to lock each baluster 34 firmly relatively to handrail 30.

Handrail 30 also is attached to newel posts 32, preferably by a tightenable fastener 104 extending outwardly from an upper portion 106 of newel post 32. As shown in detail in FIG. 10, a cavity 108 is formed within plow 102 of handrail 30 and includes a narrow channel 110 and an enlarged region 112, to allow upward or downward adjustment of rail height to accommodate variances in height of anchor strip 96. A cap strip **96*a* forms an extension of anchor strip 96 to cover cavity 108 in the finished railing 28**.

A bolt 114 of fastener 104 extends outwardly from newel post 32 through narrow channel 110, and into enlarged region 112. A nut 116 is threaded onto bolt 114, and may be operated on by a tool that would fit within enlarged region 112. For example, a socket wrench or closed-ended ratchet wrench, not shown, may be used.

Figure 11:
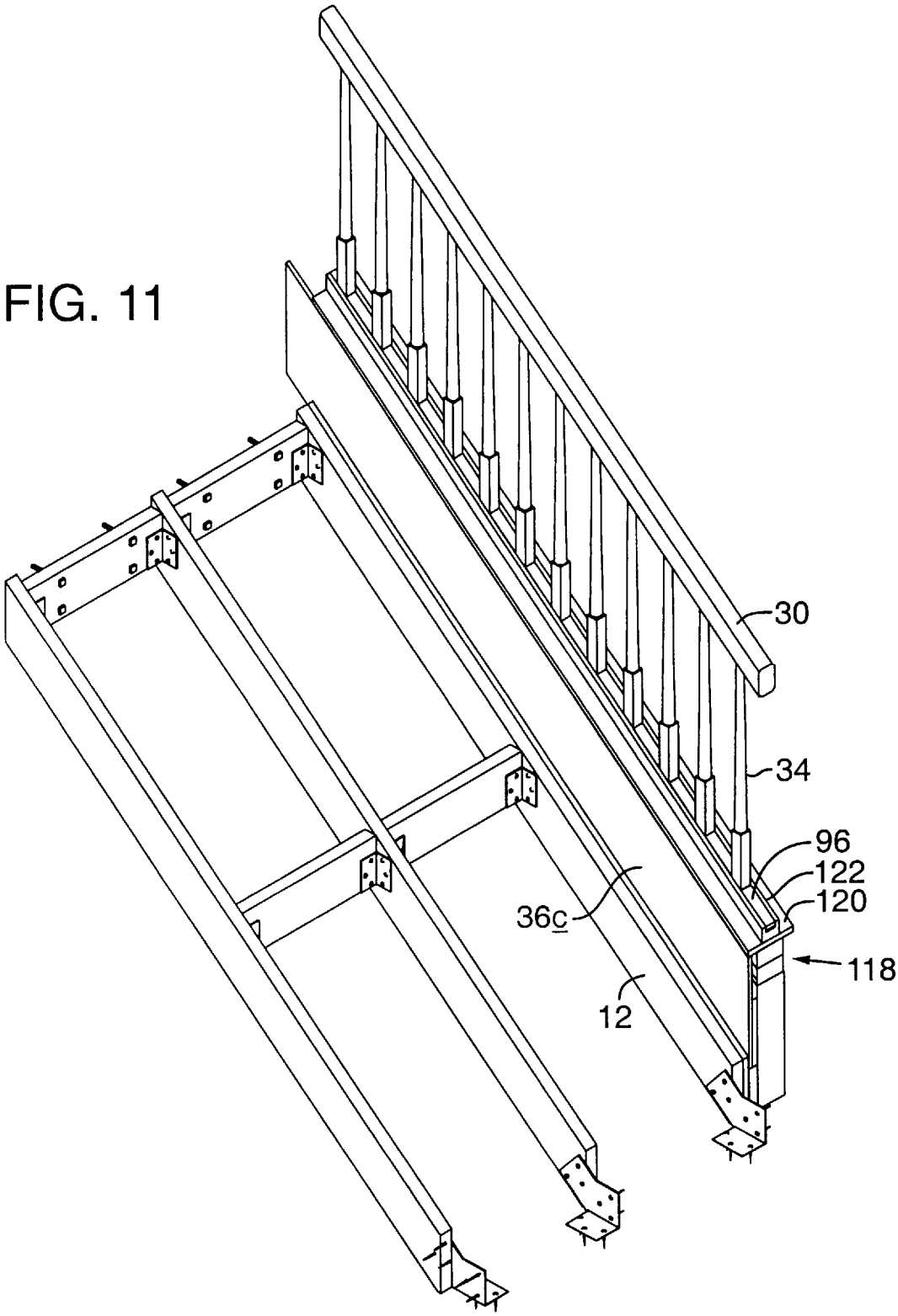
FIG. 11 is an isometric view of a frame and shoe rail railing forming a part of an alternative embodiment of the present invention, viewed similarly to FIG. 3.

Referring now to FIG. 11, yet another alternative for railing 28 is shown, in the form of a shoe rail 118. Shoe rail 118 incorporates several of the elements of the other embodiments of stairway 10, including wall skirt **36*c*. A top fascia 120 mates with wall skirt 36*c* to enclose a top of shoe rail 118**.

A channel 122 is attached to top fascia 120, to receive the bottom ends of balusters 34. More specifically, as seen best in FIG. 12, the anchor strip/plow attachment of balusters 34, shown in FIGS. 8 and 9, is used to attach balusters 34 to shoe rail 118. A plow 102 is formed in channel 122, and an anchor strip 96 is received by plow 102. Thus, the anchor strips used for attaching balusters 34 to handrail 30 and to shoe rail 118 may be virtually identical. The primary difference is that there is no need to cut off the ends of strip 96 when it is inserted into channel 122, because there is no cavity within channel 122 to which access is required after installation of strip 96.

Figure 12:
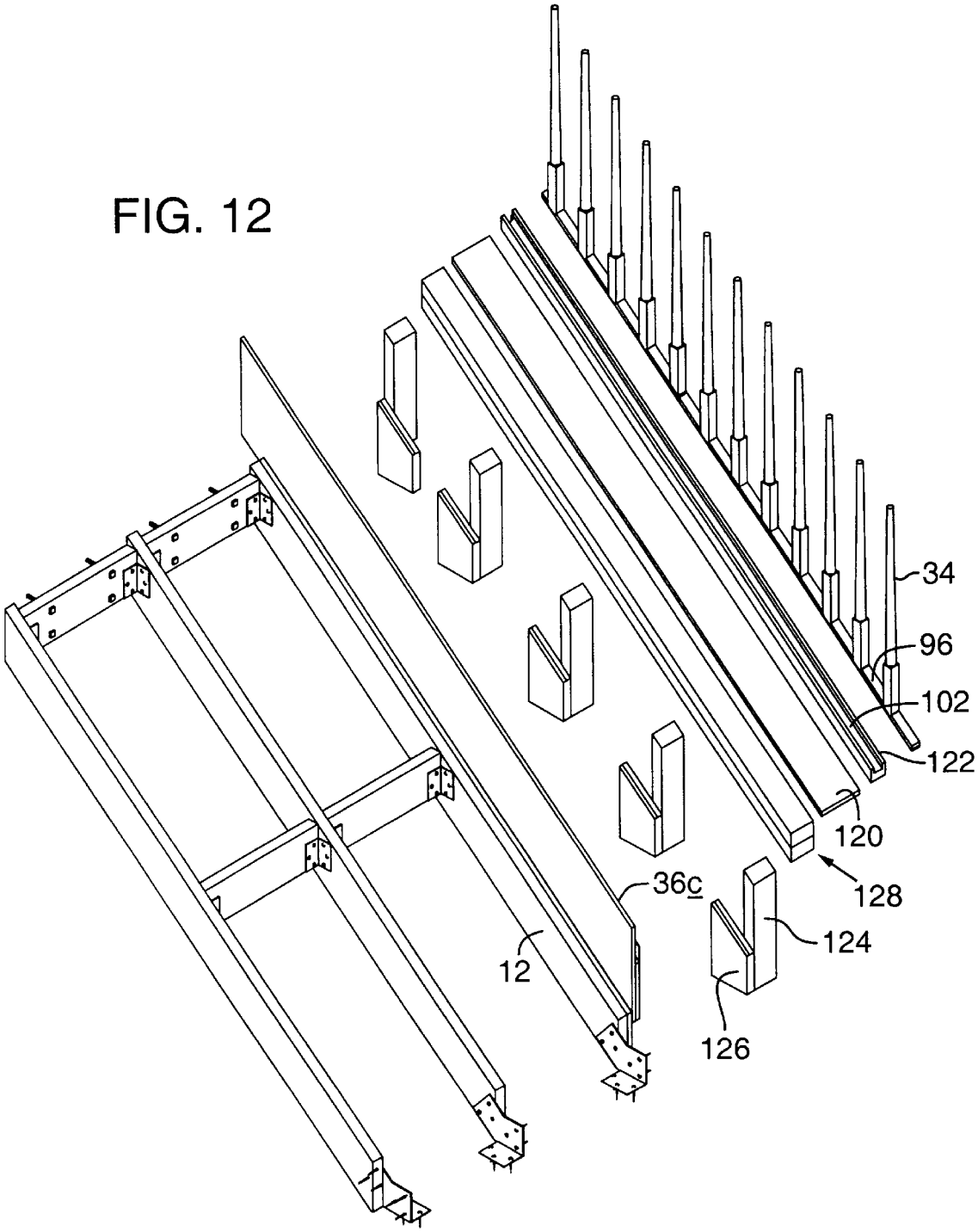
FIG. 12 is an exploded, isometric view of the frame and railing of FIG. 11.

The structure underlying top fascia 120 incorporates protective studs 124, preferably attached to stringer 12 with a mounting plate 126. It should be noted that protective studs 124 and mounting plates 126 are seen in FIG. 1. It has been found that protective studs 124 limit possible damage to wall skirt 36*c* during the construction of stairway 10, even if the shoe rail of FIGS. 11 and 12 is not included.

Improved strength of shoe rail 118 is obtained if a double-layered header 128 is applied to the tops of protective studs 124. The use of header 128, and the number of layers, will be a function of the strength of fascia 120, channel 122, and anchor strip 102. The outside edge of stairway 10 then may be covered with a fascia similar to wall skirt 36*c*, or conventional studs may be added extending down to floor 200, and the conventional studs may be enclosed with wallboard. These details are not visible in FIG. 11.

From the above-identified elements of stairway 10, it will be seen that the present invention also includes a novel method of constructing a stairway. The method includes the steps of selecting predefined stringers 12 having relatively planar, flat, module-supporting tops 38, and placing stringers 12 in position relative to a structure 200, 206. Stringers 12 are sized to match a desired rise and run for a stairway.

The next step after stringers 12 are anchored preferably includes anchoring initial step module 14 adjacent lower ends 40 of stringers 12 to define an initial riser and tread for the stairway, and to define an initial stop 50. This is followed by providing intermediate step modules 16 that define a riser and a tread for the stairway when placed on stringers 12, supporting one intermediate step module 16 on module-supporting tops 38 of stringers 12, placing a downward force on intermediate step module 16, thereby forcing module 16 along tops 38 of stringers 12 into firm contact with initial stop 50 of initial step module 14, and anchoring intermediate step module 16 to stringer 12. This insures proper alignment of intermediate step module 16 to initial step module 14. These steps are repeated for the remaining intermediate step modules 16, insuring proper alignment of each step module 16 to the adjacent step module 16.

If a railing is to be included in the stairway, the method may include the steps of providing balusters 34 and attaching balusters 34 to intermediate step modules 16 with fasteners 48 that extend through tread 20 and into interior 68 of balusters 34. Further steps may include providing newel posts 32, forming hole 58 in tread 20 of initial step module 14, and extending newel post 32 through hole 58. Newel post 32 then may be attached to rectangular block 24, preferably by forming notch 66 in rectangular block 24, so that newel post 32 is held between notch 66 and tread 22.

The modular construction of stairway 10 precludes the conventional necessity for the on-site measuring, cutting and fitting of individual stringers, treads, risers, wall skirts, under tread moldings, side skirt fascias, newel posts, balusters, and filet strips. It results in an extremely strong, quiet, nice looking stairway. It has been found to provide reliable assembly of a safe end product, with minimal skill and effort on the part of the worker installing the stairway. It also is believed to be very durable, with extensive interlocking of the various components so that the components remain anchored together firmly, with none of the creaking or squeaking often found in conventional stairways.

While the invention has been disclosed in its preferred form, it is to be understood that the specific embodiment thereof as disclosed and illustrated herein is not to be considered in a limiting sense, and that no single feature, function, or property of the preferred embodiment is essential, numerous variations are possible. The invention is to be defined only by the scope of the issued claims.

I claim:

1. A modular stairway comprising:

a stringer having a relatively planar, flat top;

an initial step module fixed substantially horizontally adjacent and on a downstairs side of lower end of the stringer, the initial step module including a block configured to abut the lower end of the stringer, and an upper edge; and a first intermediate step module attached to the stringer so that a portion of the first intermediate step module bears against the upper edge of the initial step module.

2. The stairway according to claim 1 further comprising a plurality of intermediate step modules each attached to the stringer so that a lower edge of each intermediate step module bears against an upper edge of an adjacent step module.

3. The stairway according to claim 1 wherein:

the stringer has a lower end that is vertical when the stringer is positioned for use in the stairway; and the block for abutting the lower vertical end of the stringer is formed integral with the initial step module, so that the initial step module may be attached to the stringer.

4. The modular stairway according to claim 3, wherein the integral block for the initial step module supports the tread of the initial step module substantially directly from a floor underlying the initial step module.

5. The stairway according to claim 1, further comprising a landing tread module including:

a riser fascia; and a tread attached to the riser fascia to define a leading edge for a landing at an upper end of the stairway.

6. The module of claim 5, further comprising a newel post attached to the tread of the landing tread module by a fastener extending through the tread and into an interior portion of the newel post.

7. The modular stairway according to claim 1, further comprising a newel post extending upwardly from one of the step modules, wherein the one of the step modules has a hole formed therein through which the newel post extends.

8. The modular stairway according to claim 7, wherein the hole is formed in a tread of the one of the step modules, and the newel post is attached to the one of the step modules with a fastener obstructed from view by the tread and riser of the one of the step modules when the one of the step modules is fixed adjacent the stringer.

9. The modular stairway according to claim 1, further comprising an upwardly facing elongate channel defined on the stringer for receiving an edge of a wall covering material.

10. The modular stairway according to claim 1, further comprising a bracket for attaching the stringer to a floor and an initial step module, the bracket including:

a flat floor portion;

an upright step portion; and a tilted, upright stringer portion.

11. The modular stairway according to claim 1, wherein at least one of the step modules comprises:

a tread;

a riser;

a block interconnecting the tread to the riser; and a triangular fascia member extending between the tread and the riser, sized to abut the riser, tread and stringer when the module is placed on the stringer.

12. The modular stairway according to claim 11, wherein the at least one of the step modules further comprises:

a groove formed in an exposed face of the tread; and a piece of carpet attached to the tread with an outer edge of the piece of carpet folded under and received by the groove.

13. The modular stairway of claim 11, further comprising a baluster attached to the tread by a fastener extending through the tread and into an interior portion of the baluster.

14. The modular stairway according to claim 1, wherein at least one of the step modules comprises:

a tread for attachment to the stringer;

a groove formed in an exposed face of the tread; and a piece of carpet attached to the tread with an outer edge of the piece of carpet folded under and received by the groove.

15. The modular stairway according to claim 14, wherein the groove is a rabbet formed at an outer edge of the tread.

16. The modular stairway according to claim 14, wherein the groove is a slot formed inwardly of an outer edge of the tread.

17. The modular stairway of claim 16, further comprising a baluster attached to the tread by a fastener extending through the tread and into an interior portion of the baluster.

18. The modular stairway of claim 14, further comprising a tack strip attached to the tread adjacent the groove, wherein the carpet is attached to the tread by the tack strip.

19. The modular stairway of claim 14, further comprising:

a riser for attachment to a stringer; and a groove formed in an exposed face of the riser, wherein the piece of carpet extends over and is attached to the riser with an outer edge of the piece of carpet folded under and received by the groove in the riser.

20. The modular stairway of claim 19, further comprising a tack strip attached to the tread adjacent the groove, wherein the carpet is attached to the tread by the tack strip.

21. The modular stairway of claim 20, further comprising a second tack strip attached to a top portion of the riser adjacent the groove, and a third tack strip attached to a bottom portion of the riser adjacent the groove wherein the carpet is attached to the riser by the second and third tack strips.

22. The modular stairway of claim 19 further comprising a block interconnecting the tread to the riser.

23. The modular stairway of claim 14, further comprising:

a riser for attachment to a stringer;

a groove formed in an exposed face of the riser; and a piece of carpet attached to the riser with an outer edge of the piece of carpet folded under and received by the groove.

24. The modular stairway according to claim 1, further comprising:

a baluster extending upwardly relative to at least one of the step modules;

an anchor strip attached to the baluster by a baluster fastener extending through the anchor strip and into an interior portion of the baluster, the anchor strip having indentations into which the baluster is received; and a handrail attached to the anchor strip, having a plow into which the anchor strip is received.

25. The modular stairway according to claim 24, further comprising:

a newel post extending upwardly adjacent one end of the stairway;

a cavity formed in an underside of the handrail, the cavity including a narrow channel interconnecting an end of the handrail to an enlarged region of the cavity; and a tightenable fastener extending outwardly from an upper portion of the newel post, through the channel and into the enlarged region of the cavity, wherein a tool to tighten the tightenable fastener may operate on the fastener through the enlarged region of the cavity.

26. The modular stairway according to claim 25, further comprising a cap strip inserted into the plow of the handrail to cover the cavity in the handrail.

27. The modular stairway according to claim 24, further comprising a newel post extending upwardly from a tread of the stairway, wherein the tread has a hole formed therein through which the newel post extends.

28. The modular stairway according to claim 24, further comprising:

a newel post extending upwardly from a tread of at least one of the step modules adjacent an upper end of the stairway and attached to the handrail; and a fastener extending through the tread and into an interior portion of the newel post.

29. The modular stairway according to claim 24, further comprising:

an anchor strip attached to the bottom of the baluster by a baluster fastener extending through the anchor strip and into an interior portion of the baluster, the anchor strip having indentations into which the baluster is received; and an upwardly facing channel attached to the stairway, having a plow into which the anchor strip is received.

30. A method of constructing a stairway comprising the steps of:

selecting a predefined stringer having a relatively planar, flat, module-supporting top to match a desired rise and run for a stairway;

placing the stringer in position relative to a structure;

anchoring an initial step module substantially horizontally adjacent and on the downstairs side of a lower end of the stringer to define an initial riser and tread for the stairway, and to define an initial stop, the initial step module including an integral block that is configured to abut the lower end of the stringer to insure proper alignment of the stringer relative to the initial step module;

providing an intermediate step module that defines a riser and a tread for the stairway when placed on the stringer;

supporting the intermediate step module on the module-supporting top of the stringer, and then placing a downward force on the intermediate step module thereby forcing the module along the top of the stringer into firm contact with the initial stop of the initial step module and insuring proper alignment of the intermediate step module to the initial step module; and anchoring the intermediate step module to the stringer.

31. The method according to claim 30, further comprising the steps of:

providing a plurality of intermediate step modules that each define a stop, a riser and a tread for the stairway when placed on the stringer;

supporting each intermediate step module on the module-supporting top of the stringer, and then placing a downward force on each intermediate step module thereby forcing the module along the top of the stringer into firm contact with the stop of an adjacent step module and insuring proper alignment of the step module to the adjacent step module; and anchoring each intermediate step module to the stringer.

32. The method according to claim 30, further comprising the steps of:

providing a baluster; and attaching the baluster to the intermediate step module with a fastener that extends through the tread and into the interior of the baluster.

33. The method of claim 30, wherein the step of selecting includes selecting a plurality of predefined stringers, each stringer having a relatively planar, flat, module-supporting top to match a desired rise and run for the stairway, and the step of placing includes placing the each of the stringers in a respective position relative to the structure, and wherein anchoring the initial step module forces each of the stringers to be perpendicular to the initial tread and to the initial riser.

34. The method of claim 30, wherein the step of selecting includes selecting a plurality of predefined stringers, each stringer having a relatively planar, flat, module-supporting top to match a desired rise and run for the stairway, and the step of placing includes placing the each of the stringers in a respective position relative to the structure, and wherein anchoring the intermediate step module forces each of the stringers to be perpendicular to the tread and to the riser of the intermediate step module.

35. A modular stairway comprising:

a stringer having a relatively planar, flat top;

an initial step module fixed adjacent a lower end of the stringer, the initial step module including an upper edge;

a first intermediate step module attached to the stringer so that a portion of the first intermediate step module bears against the upper edge of the initial step module;

wherein the stringer has a lower end that is vertical when the stringer is positioned for use in the stairway, the initial step module has an integral block for abutting the lower vertical end of the stringer so that the initial step module may be attached to the stringer, and the integral block for the initial step module supports the tread of the initial step module substantially directly from a floor underlying the initial step module.

36. A modular stairway comprising:

a stringer having a relatively planar, flat top;

an initial step module fixed adjacent a lower end of the stringer, the initial step module including an upper edge; and a first intermediate step module attached to the stringer so that a portion of the first intermediate step module bears against the upper edge of the initial step module; and an upwardly facing elongate channel defined on the stringer for receiving an edge of a wall covering material.

* * * * *